US005762534A

United States Patent [19]

Lo

[11] Patent Number: 5,762,534

[45] Date of Patent: Jun. 9, 1998

[54] AUTOMATIC OPENING/CLOSING MECHANISM

[76] Inventor: Yi-Chen Lo, No. 6, Alley 11, Lane 78, Chu Kuang Road, Hsin Chu, Taiwan

[21] Appl. No.: 865,979

[22] Filed: May 30, 1997

[51] Int. Cl.[6] ..... A63H 29/22; A63H 11/00

[52] U.S. Cl. ..... 446/484; 446/352; 446/464; 40/442

[58] Field of Search ..... 446/191, 311, 446/352, 353, 358, 459, 464, 484, 485; 40/442

[56] References Cited

U.S. PATENT DOCUMENTS

| | | | |
|---|---|---|---|
| 4,034,491 | 7/1977 | Fisher et al. | 40/33 |
| 4,568,308 | 2/1986 | Itoh | 446/464 |
| 5,283,970 | 2/1994 | Aigner | 42/57 |
| 5,310,377 | 5/1994 | Joja | 446/219 |

*Primary Examiner*—Robert A. Hafer
*Assistant Examiner*—Laura Fossum
*Attorney, Agent, or Firm*—Morton J. Rosenberg; David I. Klein; Jun Y. Lee

[57] ABSTRACT

An automatic opening/closing mechanism is disclosed. It includes a coil spring, a pushing member, a driven member and a contact board which are disposed in a cylinder under a decorative article. A shaft is disposed at a center of the coil spring. One end of the shaft is connected with one end face of the pushing member. The pushing member has a disc-like shape. The other end face of the pushing member is disposed with several slope teeth which are slidably engaged with several slope recesses of one end of the driven member. The other end of the driven member abuts against the contact board. Two electric contacts are disposed beside the contact board. The power of coil spring is gradually released to rotate the pushing member so as to upward push the driven member for lifting the contact board to contact with the electric contacts and close the circuit. At this time, a bulb or a music box is turned on to emit light or music. After the power of the coil spring is exhausted, the driven member is no more pushed by the pushing member and is engaged therewith to automatically shut off the electric power.

8 Claims, 8 Drawing Sheets

AUTOMATIC OPENING/CLOSING MECHANISM

BACKGROUND OF THE INVENTION

The present invention relates to an automatic opening/closing mechanism for a toy or a decorative article. When the power of the main spring of the toy or the decorative article is released, the circuit is automatically closed to supply electric power. After the power of the main spring is exhausted, the circuit is automatically opened to shut off the electric power.

FIG. 1 shows an existing toy 1 with light and music emitting effect. The toy is powered by a cell (not shown). A power switch 15 is used to control the power supply. Additionally, a coil spring (not shown) wound up by a winding wheel is usually disposed in the toy to enhance the dynamic effect. The power of the coil spring is gradually released to maintain the power through a period of time. However, after the power is exhausted with the power switch 12 still switched on, the electric power of the cell will be exhausted and wasted due to the light and the music. Also, in a conventional glass water ball (not shown), a main spring is provided for driving a decorative article to rotate in the water. In addition, a light emitting element and a sound emitting element powered by a cell are usually provided. A power switch is used to control the opening/closing of the circuit. Similarly, a user, especially a child without patience, often forgets to switch off the power switch after playing. As a result, the electric power of the cell is often quickly exhausted.

Accordingly, when the main spring is wound up and stops, the electric power cannot be synchronously supplied and shut off. This causes inconvenience and waste of the energy.

SUMMARY OF THE INVENTION

It is therefore a primary object of the present invention to provide an automatic opening/closing mechanism in which when the power of a coil spring of the toy or the decorative article is released, a pushing member upward pushes a driven member to lift a contact board so that the circuit is automatically closed to supply electric power. After the power of the main spring is exhausted, the circuit is automatically opened to shut off the electric power so as to save energy. The present invention can be best understood through the following description and accompanying drawings, wherein:

DETAILED DESCRIPTION OF THE PREFERRED EMBODIMENTS

Figure 1:
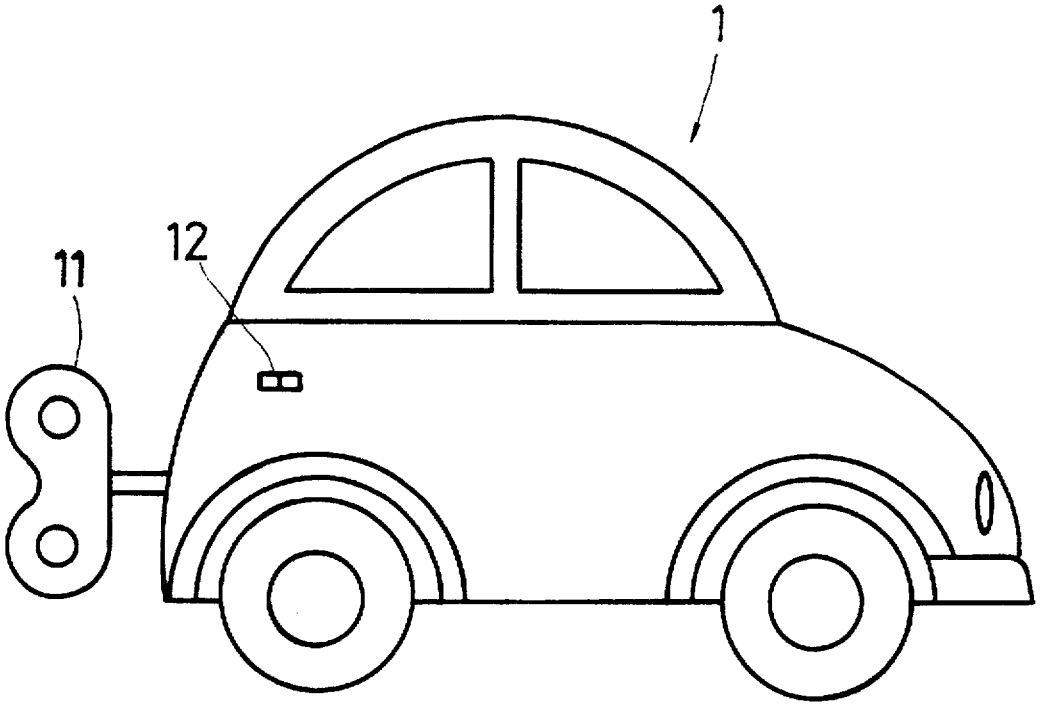
FIG. 1 is a side view of a conventional toy or decorative article.
Figure 2:
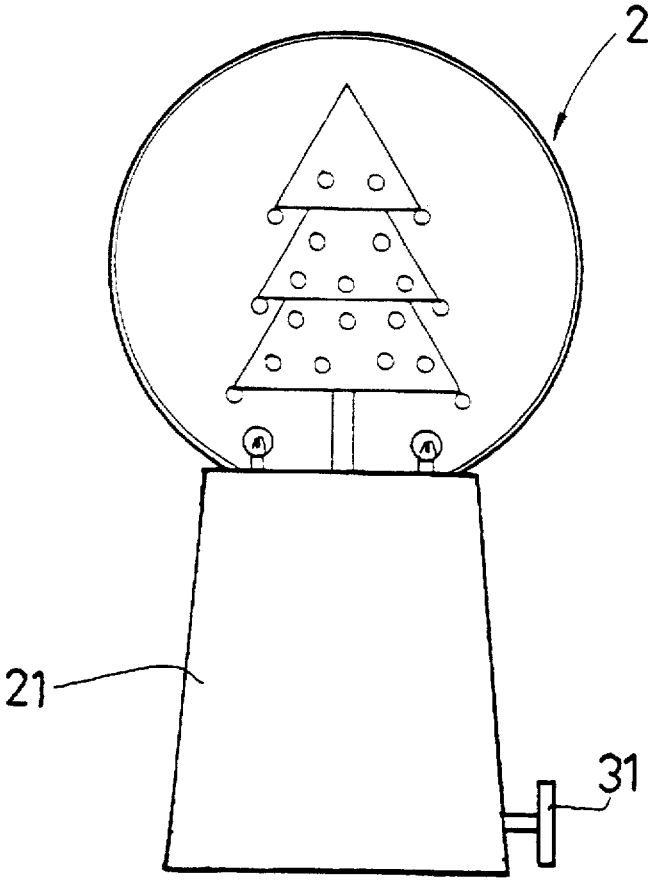
FIG. 2 is a side view of the present invention.

Please refer to FIGS. 2 to 7. According to a first embodiment, the present invention includes a coil spring 3, a pushing member 4, a driven member 5 and a contact board 6 which are disposed in a cylinder 21 under a decorative article 2. The coil spring 3 is driven by a rotary grip 31 outside the decorative article 2. An inner end of the rotary grip 31 is disposed with a bevel gear 311. A shaft 32 is disposed at the center of the coil spring 3 and another bevel gear 321 is disposed at a lower end of the shaft 32 to mesh with the first bevel gear 311. The pushing member 4 has a disc-like shape and is disposed at an upper end of the shaft 32. Four slope teeth 41 are disposed on top face of the pushing member 4. Each slope tooth 41 inclinedly extends along the circumference of the pushing member 4. The bottom face of the driven member 5 is also disposed with four slope recesses 51 accordingly. The slope teeth 41 are slidably engaged with the slope recesses 51. The top face of the driven member 5 abuts against the bottom of the contact board 6. The bottom of the contact board 6 is disposed with a projection 61. Two electric contacts 62A, 62B are disposed above the contact board 6. The contact board 6 can be guided by several vertical guiding channels (not shown) to only move up and down.

The slope teeth 41 of the pushing member 4 cooperate with the slope recesses 51 of the driven member 5, whereby when the pushing member 4 is rotated, the driven member 5 is upward pushed to lift the contact board 6 to contact with the electric contacts 62A, 62B.

Figure 3:
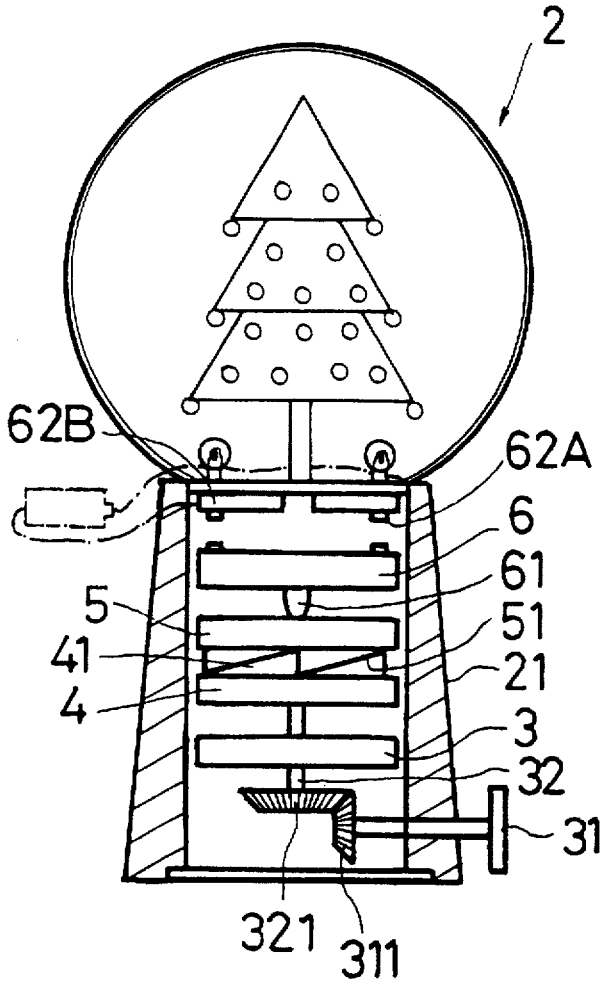
FIG. 3 is a sectional view of the present invention.
Figure 4:
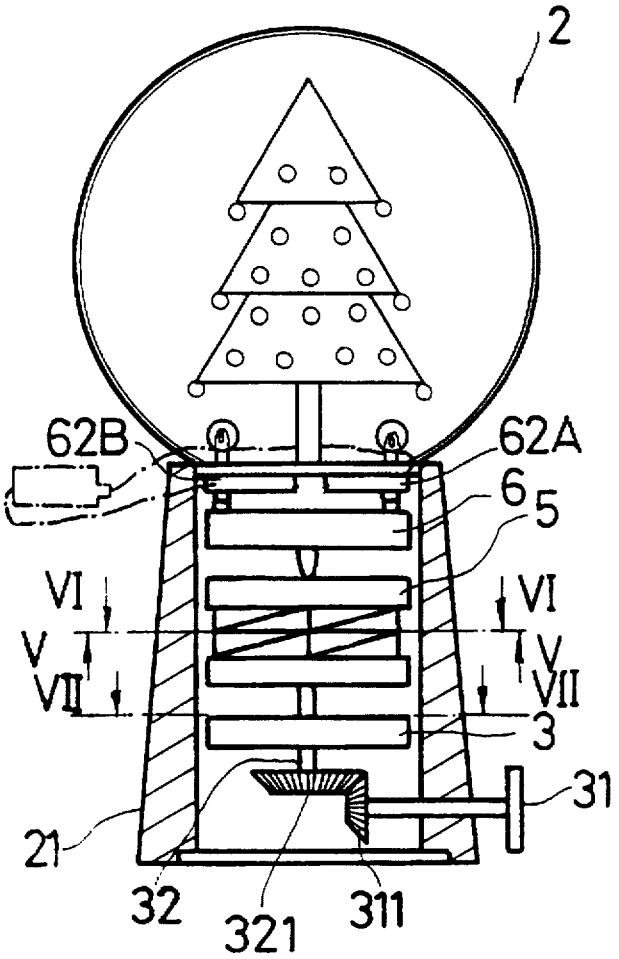
FIG. 4 is a view according to FIG. 3, showing the operation of the present invention.
Figure 5:
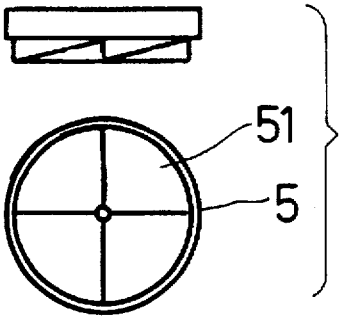
FIG. 5 is a sectional view taken along line V—V of FIG. 4.
Figure 6:
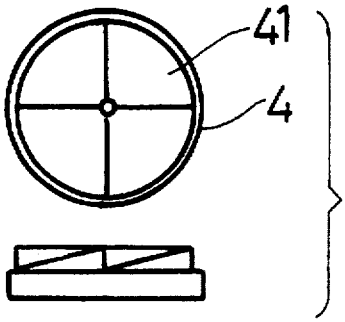
FIG. 6 is a sectional view taken along line VI—VI of FIG. 4.
Figure 7:
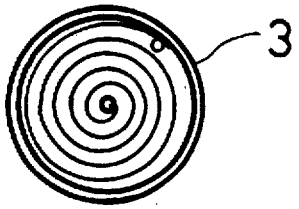
FIG. 7 is a sectional view taken along line VII—VII of FIG. 4.

In use, the rotary grip 31 is first rotated by a certain circles to tighten the coil spring 3 so as to conserve power. The power of the coil spring 3 will be gradually released to rotate the shaft 32. The shaft 32 then drives the pushing member 4 to rotate to push the driven member 5 upward. Accordingly, the driven member 5 lifts the contact board 6 to contact with the electric contacts 62A, 62B so as to close the circuit which is formed by a cell (shown by phantom line) and a bulb 22 as shown in FIG. 3. Therefore, the bulb 22 at the upper end of the decorative article 2 is turned on (or a sound is emitted).

Figure 8:
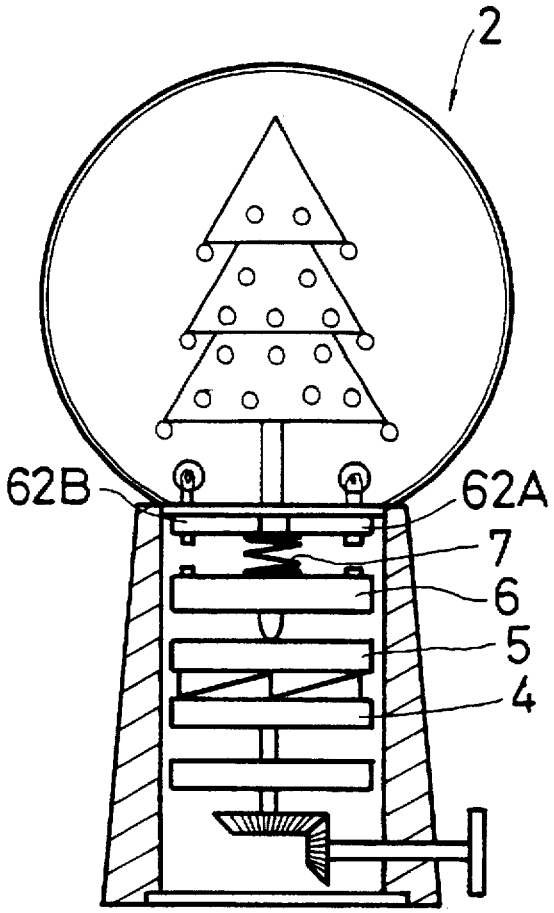
FIG. 8 is a sectional view of a second embodiment of the present invention.
Figure 9:
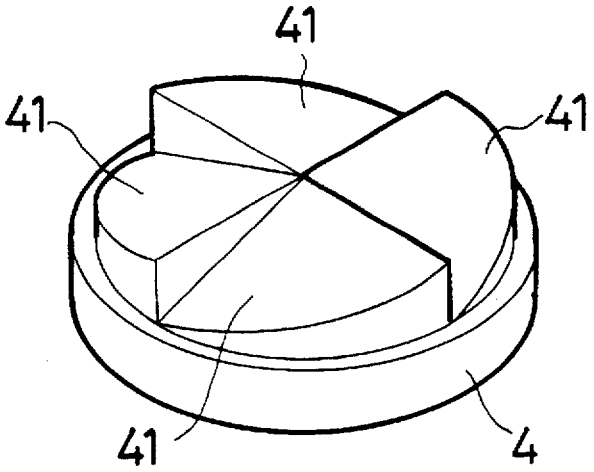
FIG. 9 is a perspective view of the pushing member of the present invention.

After a period of time, the power of the coil spring 3 will be exhausted and the pushing member 4 will no more lift the driven member 5. At this time, due to the weight of pushing member 4, the slope teeth 41 of the pushing member 4 will again engage with the slope recesses 51 of the driven member 5. Therefore, the contact board 6 no more contacts with the electric contacts and the circuit is opened to automatically turn off the bulb. Accordingly, after the power of the coil spring disappears, the electric supply is automatically shut off so as to save energy. Such measure can be widely applied to various kinds of toys and decorative articles. FIG. 8 shows a second embodiment of the present invention, in which a compression spring 7 is disposed between the contact board 6 and the upper end of the cylinder 21. The compression spring 7 such functions that when the coil spring 3 loses its power, the compression spring 7 will keep the contact board 6 separating from the electric contacts 62A, 62B so as to avoid electric power loss due to swinging or shocking.

Figure 10:
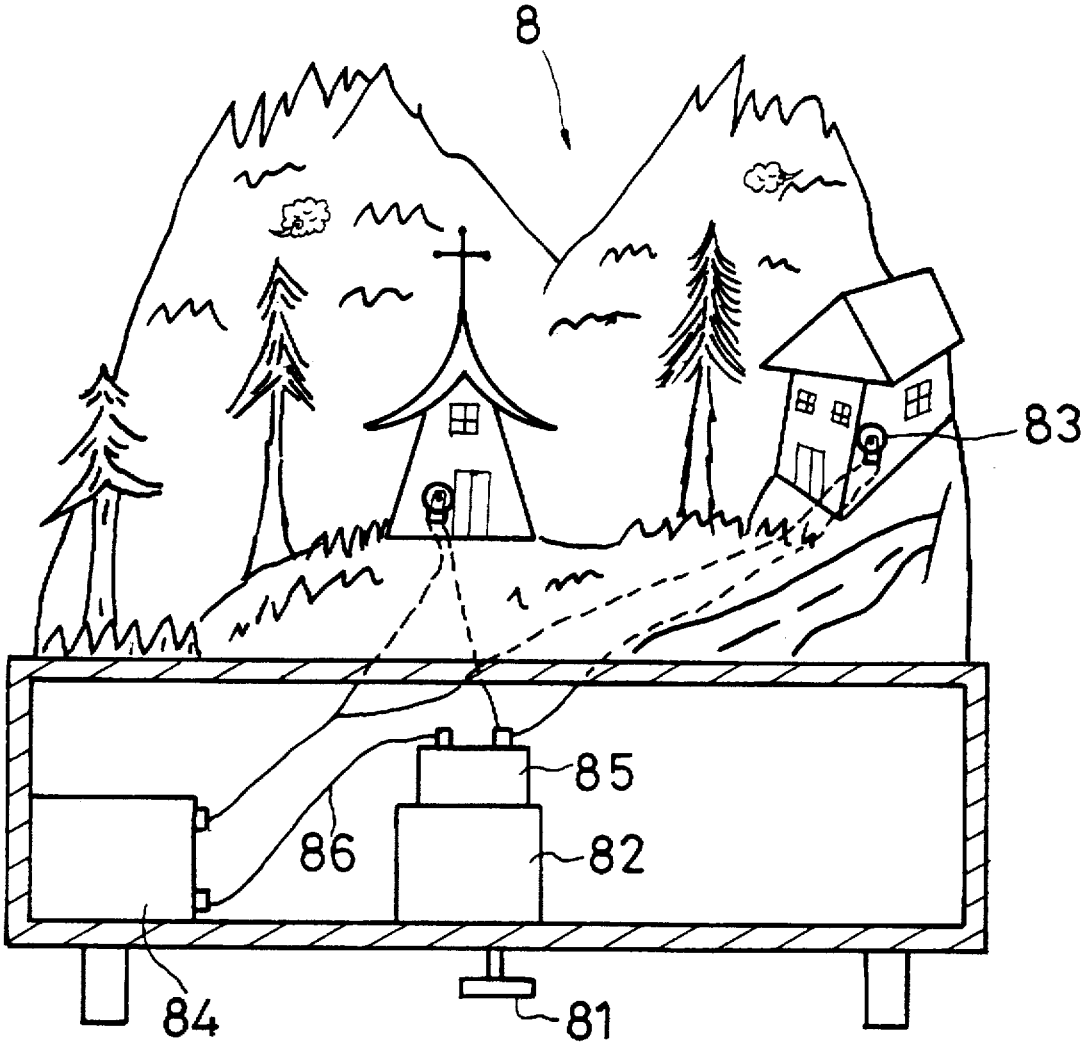
FIG. 10 shows the application of the present invention.

FIG. 10 shows the application of the present invention to a Christmas decorative article 8 which includes a winding wheel 81, a music box 82, several light emitting elements 83, a cell box 84, an automatic opening/closing mechanism 85 and several wires 86. When rotating the winding wheel 81, the music box 82 is driven to emit music. Also, by means of the automatic opening/closing mechanism 85, the circuit is closed to turn on the light emitting elements 83. After the winding wheel stops, the music box 82 stops emitting the music and the light emitting elements 83 are automatically turned off.

It is to be understood that the above description and drawings are only used for illustrating some embodiments of the present invention, not intended to limit the scope thereof. Any variation and derivation from the above description and drawings should be included in the scope of the present invention.

What is claimed is:

1. An automatic opening/closing mechanism in a decorative article comprising:

a cylindrical base having an automatic opening/closing mechanism therein, and a decorative article being disposed on an upper end of said cylindrical base;

said decorative article having an electrical feature which is actuated by an electrical circuit connected to said mechanism;

said mechanism having a coil spring with a centrally disposed shaft, the shaft being connected at an one end to a lower face of a disc-shaped pushing member, said pushing member being disposed with several sloped teeth on an upper face which is opposite said lower face of said disc-shaped pushing member, a driven member having a lower end with several sloped recesses thereon sized to slidably engage with said several sloped teeth on said upper face of said pushing member, said driven member having an upper end, opposite said lower end, which abuts against a first side of a contact board, a second side of said contact board being located adjacent two electrical contacts which are electrically connected to said electrical circuit of said decorative article; and wherein said mechanism is configured and arranged such that when power in the coil spring is released, the coil spring rotates the pushing member thereby upwardly pushing the driven member and lifting the contact board to contact with the electrical contacts and close the circuit thereby actuating the electrical feature of the decorative article, and wherein after the power of the coil spring is exhausted, the driven member disengages the pushing member which separates the contact board and the electrical contacts, thereby automatically opening the electrical circuit and deactuating the electrical feature of the decorative article.

2. A mechanism as claimed in claim 1, wherein the other end of the shaft is disposed with a gear.

3. A mechanism as claimed in claim 1, wherein the electric contacts are respectively connected to a bulb and a cell to form said circuit.

4. A mechanism as claimed in claim 1, wherein each sloped tooth inclinedly extends along a circumference of the pushing member.

5. A mechanism as claimed in claim 1, wherein each sloped recess inclinedly extends from said lower end of the driven member along a circumference thereof.

6. A mechanism as claimed in claim 1, wherein the decorative article is a glass ball.

7. A mechanism as claimed in claim 1, wherein the decorative article is a toy.

8. A mechanism as claimed in claim 1, wherein there are at least three sloped teeth and three sloped recesses.

* * * * *